US005410991A

United States Patent [19]

Beaudry et al.

[11] Patent Number: 5,410,991

[45] Date of Patent: May 2, 1995

[54] COOLANT FILL HOUSING WITH INTEGRAL THERMOSTAT

[75] Inventors: Edward R. Beaudry, Methuen, Mass.; Eric B. Thorstensen, Hampton Falls, N.H.; Wayne R. Duprez, Waltham, Mass.

[73] Assignee: Standard-Thomson Corporation, Waltham, Mass.

[21] Appl. No.: 238,648

[22] Filed: May 5, 1994

[51] Int. Cl.[6] ..... F01P 7/16

[52] U.S. Cl. ..... 123/41.1; 236/34.5

[58] Field of Search ..... 123/41.01, 41.09, 41.1, 123/41.54; 236/34, 34.5, 101 C

[56] References Cited

U.S. PATENT DOCUMENTS

| | | | |
|---|---|---|---|
| 3,221,720 | 12/1965 | Dangauthier | 123/41.09 |
| 3,242,914 | 3/1966 | Benger, Sr. | 123/41.1 |
| 3,623,462 | 11/1971 | Anders et al. | 123/41.54 |
| 3,700,166 | 10/1972 | Foults | 236/34.5 |
| 3,817,450 | 6/1974 | Mischke | 236/34.5 |
| 3,989,103 | 11/1976 | Cieszko et al. | 123/41.54 |
| 4,103,824 | 8/1978 | Siefert | 236/34.5 |
| 4,186,872 | 2/1980 | Bland, Jr. et al. | 236/34.5 |
| 4,196,847 | 4/1980 | Gobien | 236/34.5 |
| 4,300,718 | 11/1981 | Beyer | 236/34.5 |
| 4,358,051 | 11/1982 | Hunt | 236/34.5 |
| 4,431,133 | 2/1984 | Roberson, Sr. | 236/34.5 |
| 4,434,750 | 3/1984 | Edelmann | 236/34.5 |
| 4,509,465 | 4/1985 | Edelmann | 236/34.5 |
| 4,510,893 | 4/1985 | Schweiger et al. | 123/41.54 |
| 4,606,302 | 8/1986 | Huemer et al. | 236/34.5 |
| 4,623,092 | 11/1986 | Arndt et al. | 237/12.3 C |
| 4,739,824 | 4/1988 | Howcroft | 123/41.54 |
| 4,787,445 | 11/1988 | Howcroft | 123/41.54 |
| 4,856,581 | 8/1989 | Santoro | 165/130 |
| 4,883,225 | 11/1989 | Kitchens | 236/34.5 |
| 4,913,107 | 4/1990 | Schweiger | 123/41.54 |
| 4,964,371 | 10/1990 | Maeda et al. | 123/41.1 |
| 4,993,628 | 2/1991 | Reynolds | 236/34.5 |
| 5,111,774 | 5/1992 | Hiramoto et al. | 123/41.1 |
| 5,111,776 | 5/1992 | Matsushito | 123/41.54 |
| 5,123,591 | 6/1992 | Reynolds | 236/34.5 |
| 5,248,052 | 9/1993 | Mellinger et al. | 123/41.54 |

*Primary Examiner*—Noah P. Kamen
*Attorney, Agent, or Firm*—Barnes & Thornburg

[57] ABSTRACT

An apparatus is provided for filling an engine cooling system with coolant fluid and for controlling fluid flow through the cooling system using three dimensional weirs in response to changes of an engine cooling system temperature. The apparatus includes a fill housing having an inlet section, an outlet section, and a fill section configured to receive a cap thereon. The inlet section is formed to include a valve seat and a flange for coupling the fill housing to an engine. The apparatus also includes a thermostat and means for coupling the thermostat to the flange to hold the thermostat within the inlet section beneath an outer surface of the flange. The fill housing is formed to include a venturi portion located between the inlet section and the outlet section to provide a pressure drop in the fill housing as fluid flows through the fill housing. The venturi portion is located adjacent the fill section to subject the fill section to the pressure drop as fluid flows through the fill housing.

30 Claims, 4 Drawing Sheets

COOLANT FILL HOUSING WITH INTEGRAL THERMOSTAT

BACKGROUND AND SUMMARY OF THE INVENTION

The present invention relates to a coolant fill housing for a vehicle coolant system. More particularly, the present invention relates to a coolant high fill housing for the coolant system of the vehicle which provides a revised fluid flow path and which includes an integrally mounted thermostat for controlling fluid flow through the vehicle coolant system.

As automotive industry design trends dictate a lower front end profile for vehicles, it becomes necessary for the radiator of the vehicle to be mounted below the highest point of the engine. In this instance, there is a need for a fill point at a location higher than the radiator in order to insure complete filling of the coolant system. This high fill point is typically located at the coolant outlet of the engine. Therefore, a high fill housing is provided to permit an operator to fill the coolant system of the vehicle with fluid. The present invention provides a coolant fill housing which includes an integrally mounted thermostat and a radiator cap to provide system closure, control fluid flow, and regulate the pressure of the coolant system.

Advantageously, the present invention provides a unique coolant fill housing and thermostat design that provides a single fully functional part of the coolant system, including the fill housing, radiator cap, and thermostat. Providing the coolant fill housing with an integral thermostat reduces parts and overall labor and material cost. In addition, providing an integral thermostat eliminates the possibility of inserting inverted thermostats in automobiles. Advantageously, testing of a complete radiator cap and thermostat system can be combined prior to shipment in the coolant fill housing of the present invention.

Another feature of the present invention is the provision of venting through the coolant fill housing with the integral thermostat mounted therein. A vent channel allows air passage when fluid flow enters the coolant system from the radiator side such as in the case of a forced fluid fill into the fill housing. Air passes through the vent channel and eliminates air entrapment. Fluid pressure from the engine side of the coolant system closes a valve in the vent channel to restrict fluid flow through the vent channel.

Yet another feature of the present invention is the provision of an integral thermostat and coolant fill housing with a controlled fluid flow feature. The apparatus of the present invention uses weir channels formed in the housing adjacent the thermostat valve. The design of the present invention allows a moderate flow of fluid to escape through the weir channels as the thermostat valve begins to open. This moderate initial fluid flow eliminates a sudden surge of coolant that often occurs when a typical thermostat is used to control fluid flow. For other examples of references including weirs, see U.S. Pat. Nos. 4,053,105; 4,164,332; and 4,286,750.

Still another feature of the present invention is the provision of means within the coolant fill housing for reducing the pressure in the coolant fill housing adjacent a fill section of the housing. In the illustrated embodiment, a venturi is located within a main flow path of the fill housing to generate a low pressure area or pressure drop immediately down stream from the venturi. The pressure decreases proportionally as engine coolant flow through the fill housing increases. By locating the venturi adjacent the fill section of the fill housing, the radiator cap which closes off the fill port is subjected to the lower pressure as fluid flows through the fill housing. This reduced pressure offsets the increased pressure generated by pump discharge flow and radiator core restriction and allows the system to function properly at all discharge flow rates.

According to one aspect of the present invention, an apparatus is provided for filling an engine cooling system with coolant fluid and for controlling fluid flow through the cooling system in response to changes of an engine or system coolant temperature. The apparatus includes a fill housing having an inlet section, an outlet section, and a fill section configured to receive a cap thereon. The inlet section is formed to include a valve seat and a flange for coupling the fill housing to an engine. The apparatus also includes a thermostat and means for coupling the thermostat to the flange to hold the thermostat within the inlet section beneath an outer surface of the flange.

In the illustrated embodiment, the thermostat includes a movable valve member for engaging the valve seat of the fill housing to block the flow of fluid past the valve member and into the inlet section, a retaining frame coupled to the flange for holding the thermostat within the inlet section beneath the outer surface of the flange, and a spring extending between the retaining frame and the movable valve member for biasing the movable valve member to a normally closed position against the valve seat. The retaining frame is preferably coupled to the flange by a bayonet attachment to hold the thermostat in the inlet section of the fill housing beneath the outer surface of the flange. The thermostat also includes a thermally responsive actuator coupled to the movable valve member for moving the movable valve member to an open position away from the valve seat when the ambient temperature exceeds a predetermined temperature to permit fluid flow from the engine into the inlet section of the fill housing.

Also in the illustrated embodiment, the thermally responsive actuator of the thermostat includes a stem portion and a power element. The fill housing includes an internal rib positioned in the inlet section downstream from the valve seat for supporting the stem portion. The internal rib is formed integrally with the fill housing. The internal rib and the fill housing may be made from a plastic or other suitable material.

In one illustrated embodiment, the fill housing is formed to include a weir channel adjacent the valve seat to permit fluid flow through the weir channel as the valve member moves away from the valve seat. In another embodiment, the fill housing is formed to include a vent channel and a valve located in the vent channel. The vent channel includes an enlarged portion, and the valve includes a ball located in the enlarged portion to open and close the vent channel. The apparatus further includes a flexible lip portion formed adjacent the enlarged portion of the vent channel to permit the valve ball to be inserted into the enlarged portion of the vent channel.

According to another aspect of the present invention, a fill housing apparatus is provided for filling an engine cooling system with coolant fluid. The apparatus includes an inlet section, an outlet section, and a fill section configured to receive a removable cap thereon to permit coolant fluid to be added to the cooling system. The apparatus also includes a venturi portion located between the inlet section and the outlet section to provide a pressure drop inside the fill housing as fluid flows through the fill housing.

In the illustrated embodiment, the outlet section is aligned at an obtuse angle relative to the fill section to reduce fluid flow into the fill section as fluid flows from the inlet section to the outlet section of the fill housing. The venturi portion is located adjacent the fill section to subject the fill section to the pressure drop as fluid flows through the fill housing.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
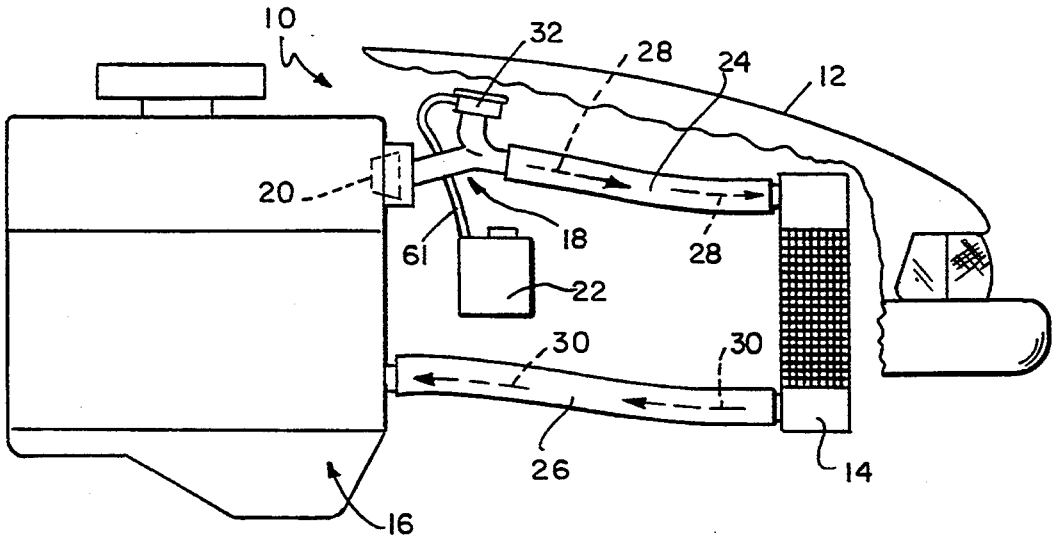
FIG. 1 is a diagrammatical view of a vehicle engine and a coolant system including a radiator and a coolant fill housing of the present invention coupled to the engine for filling the coolant system with fluid.

Referring now to the drawings, FIG. 1 illustrates an engine coolant system 10 of a vehicle 12. Recent automotive industry design trends have provided vehicles having a lower front end profile. Therefore, a radiator 14 must be located at a position which is lower than the highest point of an engine 16. Therefore, it is necessary to provide a coolant fill housing 18 mounted to engine 16 at the highest location of the coolant system 10 in order to fill the coolant system 10 with fluid. Coolant system 10 includes a thermostat 20 mounted in fill housing 18, a separate fluid reservoir 22, an upper hose 24 for coupling fill housing 18 to radiator 14, and a lower hose 26 for coupling radiator 14 to engine 16. When thermostat 20 moves to an open position to permit coolant fluid flow through coolant system 10, fluid flows through fill housing 18 and hose 24 in the direction of arrows 28 to radiator 14. Fluid then returns from radiator 14 to engine 16 through hose 26 in the direction of arrows 30. A radiator cap 32 is removably mounted on high fill housing 18 to permit coolant to be added to coolant system 10. Cap 32 provides system closure and regulates the pressure of coolant system 10.

In coolant system 10, a pressure drop occurs across radiator 14. In other words, the pressure is higher at the coupling point of upper hose 24 and radiator 14 than it is at the coupling point of radiator 14 and lower hose 26. In a conventional coolant system, the radiator cap is located on radiator 14 which is downstream from the radiator pressure drop.

In the coolant system 10 illustrated in FIG. 1, relocation of radiator cap 32 from a position downstream of the radiator pressure drop to position upstream of the radiator 14 causes a lowering of the effective relief pressure of cap 32 and a detrimental effect on the temperature tolerance of the entire cooling system 10. Since the pressure drop of radiator 14 is a function of the fluid flow through radiator 14, the effective difference in pressure experienced by cap 32 increases as fluid flow through radiator 14 increases.

Figure 2:
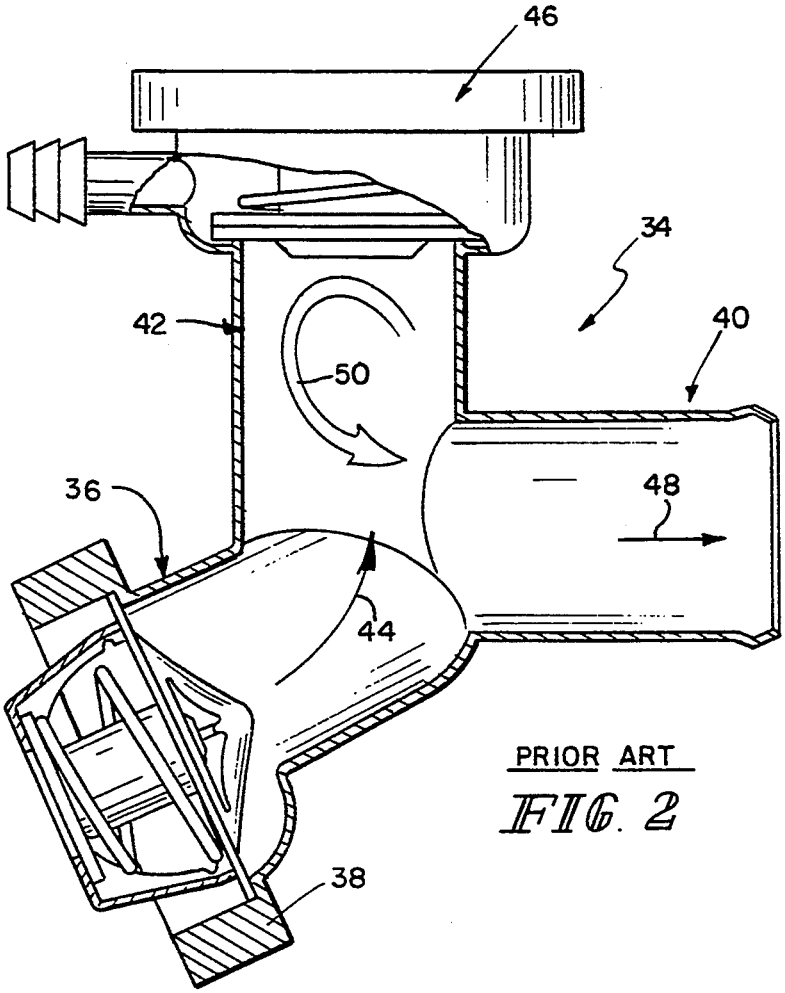
PRIOR ART FIG. 2
FIG. 2 illustrates the configuration and fluid flow path of a conventional coolant fill housing.

A conventional high fill housing 34 illustrated in FIG. 2 includes an inlet section 36 having a flange 38 for coupling fill housing 34 to engine 16. Fill housing 34 also includes an outlet section 40 and a fill section 42. As the fluid flows from engine 16 through inlet section 36 in the direction of arrow 44, a large portion of the fluid is directed upwardly into fill section 42 toward cap 46. Fluid then exits toward the radiator in the direction of arrow 48 at substantially a right angle relative to the initial flow direction 44. This impingement on cap 46 during a high fluid flow operation contributes to the lowering of the effective relief pressure of cap 46. In addition, extreme turbulence is generated in the fill section 42 of fill housing 46 as illustrated by arrow 50. Such turbulence can cause a dislodging of a cap vent (make up) valve, thereby preventing cap 46 from maintaining the proper pressure of coolant system 10 and causing coolant loss and subsequent overheat.

Figure 3:
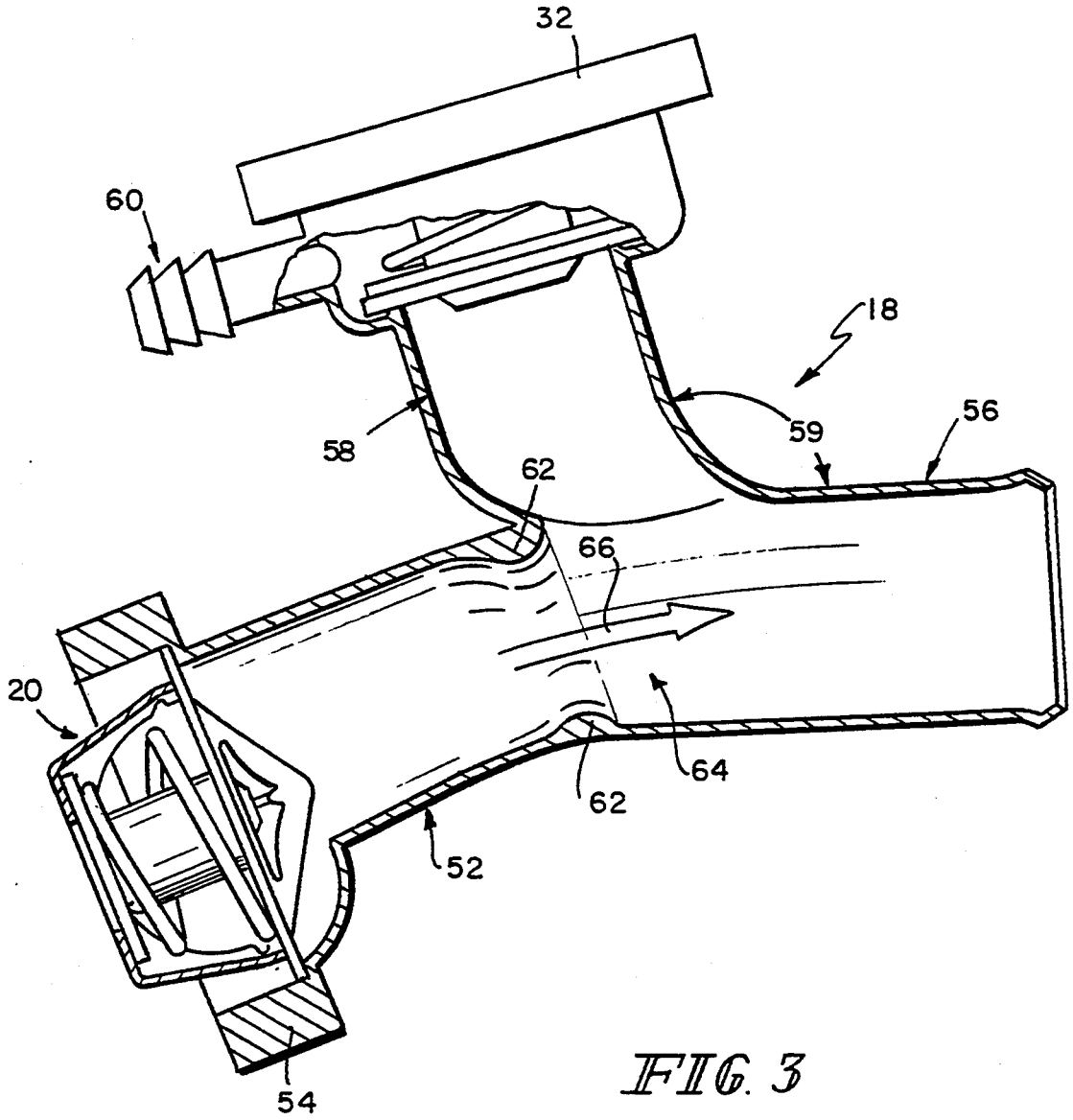
FIG. 3 illustrates the configuration and fluid flow path through the coolant fill housing of the present invention.

The high fill housing 18 of the present invention is designed to reduce or minimize the problems associated with the conventional high fill housing 34. High fill housing 18 of the present invention is best illustrated in FIG. 3. Housing 18 includes a fluid inlet section 52 having a flange 54 for coupling high fill housing 18 to engine 16. In FIG. 3, a conventional thermostat 20 is mounted in flange 54 of fill housing 18. In accordance with another aspect of the present invention, the thermostat can be mounted integrally with fill housing 18 as discussed below in detail with reference to FIGS. 4–12. However it is understood that the novel configuration of the high fill housing 18 may also be used without the integral thermostat feature.

High fill housing 18 also includes an outlet section 56 for directing coolant flow toward radiator 14 and a fill section 58. Inlet section 52 and outlet section 56 provide a main fluid flow path through fill housing 18. Radiator cap 32 is coupled to fill section 58. Barbed section 60 is configured to be coupled to a hose 61 in FIG. 1 which leads to reservoir 22. Housing 18 is preferably made from a plastic material, but may be made from metal if desired.

The configuration of the high fill housing 18 of the present invention prevents direct impingement of coolant flow on radiator cap 32. Fill system 58 is aligned at an obtuse angle relative to outlet section 56 as illustrated by angle 59. The fill housing 18 is designed so that cap 32 is located in a relatively quiet portion of housing 18 which is out of the main flow path of coolant exiting engine 16. The main flow path is through inlet section 52 and outlet section 56. The configuration of coolant housing 18 illustrated in FIG. 3 is designed to reduce the likelihood of malfunction of the vent valve components of cap 32. In addition, housing 18 is configured to incorporate a venturi 62. The venturi 62 provides a reduced diameter section to generate a low pressure area or pressure drop inside housing 18 immediately downstream from venturi 62 at location 64. The pressure at area 64 decreases proportionately as engine coolant flow increases. Fill section 58 is located adjacent low pressure area 64 so that cap 32 is subjected to the lower pressure as fluid flows through housing 18 in the direction of arrow 66. This low pressure effect offsets the increased pressure generated by radiator 14 flow restriction as fluid flow rates increase and allows the coolant system 10 to function properly at all fluid flow rates.

Figure 5:
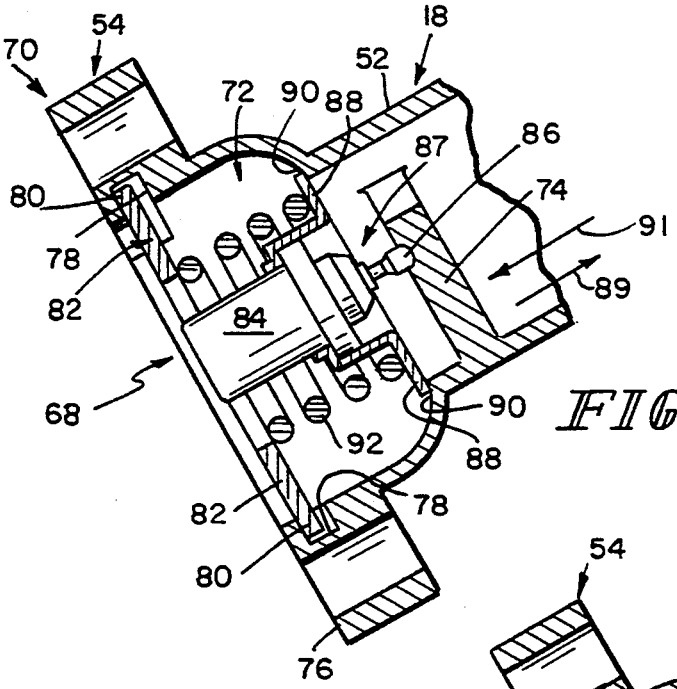
FIG. 5 is a sectional view taken through a first embodiment of the present invention illustrating the thermostat in a closed position to block fluid flow through the coolant fill housing.
Figure 6:
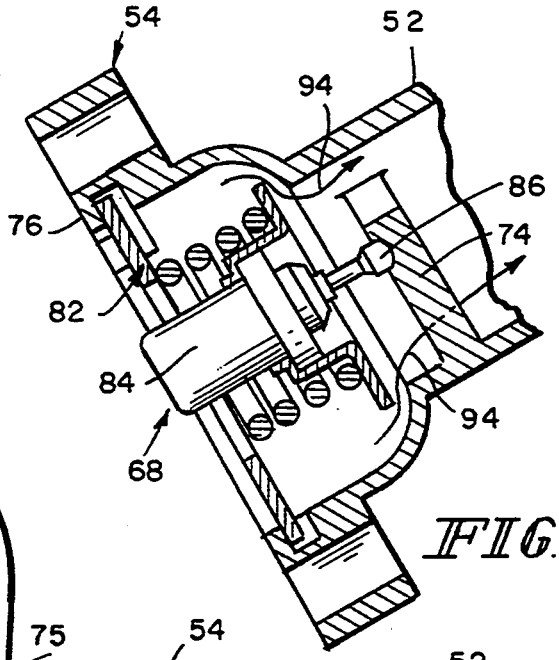
FIG. 6 is a sectional view similar to FIG. 5 in which a movable valve member of the thermostat has moved to an open position to permit coolant flow through the coolant fill housing.
Figure 4:
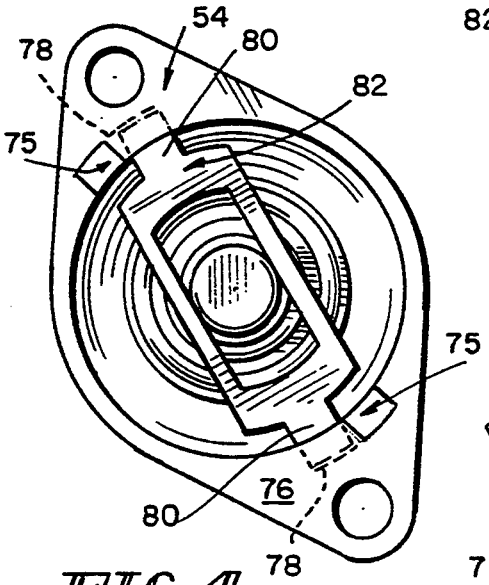
FIG. 4 is an end elevational view illustrating the manner in which an integral thermostat is coupled to the coolant fill housing of the present invention.

As discussed above, another feature of the present invention is the provision of a thermostat which is mounted integrally with coolant fill housing 18. It is understood that such integrally mounted thermostat may be used on any coolant high fill housing or other styled outlet housings. One embodiment of the integral thermostat arrangement is illustrated in FIGS. 4–6. A thermostat 68 is coupled to an inlet end 70 of high fill housing 18. Inlet end 70 includes flange 54, a mouth portion 72, and inlet section 52. A stem retainer 74 is preferably molded integrally with housing 18 from a plastic material. A metal insert may also be used for stem retainer 74. As illustrated in FIG. 4, flange 54 is formed to include a pair of diametrically opposed notches 75 cut into outer surface 76. Notches 75 communicate with slots 78 and are configured to receive tabs 80 on spring retraining frame 82 to provide a bayonet type attachment. Thermostat 68 includes a power element 84 and, a stem 86 which provide a thermally responsive activator 87, a valve 88 for engaging a valve seat 90, and a return spring 92 for applying a biasing force against valve 88 in the direction of arrow 89 to hold valve 88 in a normally closed position against valve seat 90 to block fluid flow from engine 16 into fill housing 18. As illustrated in FIG. 5, tabs 80 of retaining frame 82 are located within slots 78 formed in flange 54 to secure thermostat 68 to fill housing 18. Spring 96 holds retaining frame 82 within slots 78.

As discussed above, fill housing 18, retaining frame 82, and valve 88 are typically made from plastic. However, a metal material may be substituted depending on operating conditions, fluid composition, and customer preference. As fluid temperature in engine 16 increases, wax in the power element 84 of thermally responsive actuator 87 expands to move element 84 on stem 86. Stem 86 pushes against stem retainer 74 and forces the power element 84 to move in the direction of arrow 91. Valve 88 is coupled to power element 84. Therefore, as power element 84 moves in the direction of arrow 91, valve 88 moves away from valve seat 90 to permit fluid to pass through fill housing 18 in the direction of arrows 94 in FIG. 6. Fluid moving in the direction of arrows 94 passes through fill housing 18 to radiator 14 to cool the fluid. As the fluid is cycled back and cooled, the wax inside power element 84 solidifies and valve 88 forced back to its closed position by spring 92 to block fluid flow through fill housing 18.

Because thermostat 68 is integrally mounted with fill housing 18, the present invention eliminates the possibility of inserting thermostat 68 into the fill housing 18 in an inverted manner. Typically, thermostat 68 is preassembled into fill housing 18 and the entire assembly is tested and sold as a component to be added to a new or used engine cooling system 10. The "built-in" thermostat uses part of the engine's coolant flow system as part of its own assembly. Advantageously, internal rib 74 for engaging stem 86 is molded into fill housing 18. This provides retention of stem 86 without an additional piece part.

Retaining frame 82 holds spring 92 and the other thermostat components inside fill housing 18. This snap in retaining frame 82 eliminates a manufacturing peening operation generally required in a typical thermostat flange to frame assembly. Coining of frame tabs after insertion into flange slots would not be required. The snap in or twist in design of thermostat 62 is less troublesome than peening. Because frame 82 is coupled to a relatively thick walled flange 54, the potential for frame 82 breaking away from flange 54 is reduced. Advantageously, sealant between thermostat 68 and a mating surface is not be required since the thermostat 68 is internal to the fill housing 18 and not added on. Once installed as an internal portion of fill housing, thermostat 68 operates in the same manner as a typical engine coolant thermostat would operate. At elevated temperatures, thermostat 68 opens valve 88 to direct flow to radiator 14 for cooling. Thermostat 68 returns to its closed position as engine temperature lowers.

Figure 7:
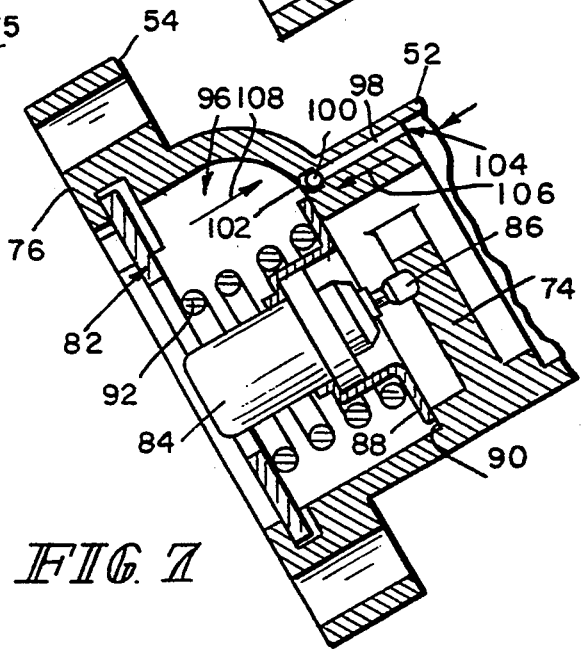
FIG. 7 is a sectional view of another embodiment of the present invention which is formed to include a vent channel and valve ball or other shaped restrictor therein for venting air through the coolant fill housing or other shaped restrictor.

Another embodiment of the present invention is illustrated in FIG. 7. Elements in FIG. 7 referenced by numbers identical to numbers in FIGS. 1–6 perform the same or similar function. In FIG. 7, an offset mouth portion 96 is provided. The FIG. 7 embodiment provides the same internal design as FIGS. 4–6, but includes a venting feature. Fill housing 18 is formed to include a vent channel 98 extending between mouth 96 and inlet section 52. Vent channel 98 is located in a wall area within fill housing 18 where wall thickness is greater. The vent channel may be used in housings with both offset and non-offset designs. An expanded section 102 of the vent channel is located adjacent valve 88 seats on valve seat 90. A ball 100 or another shaped restrictor made from a plastic or metal material is located in expanded section 102 of vent channel 98 near mouth 96. Ball 100 is restrained within enlarged portion 102 of vent channel 98 by a molded lip which is flexible enough to permit the ball 100 to be pressed into expanded area 102 during manufacture. Other suitable methods of retention may be used to secure vent ball 100 or the restrictor. A cone shaped restrictor, cup shaped restrictor, or other means for blocking the vent channel 98 may be provided in place of ball 100. Vent channel 98 permits air passage as flow enters the coolant system 10 from the radiator side such as when a forced fluid fill is added through fill section 58 of fill housing 18. Air passes through the vent channel 98 inside enlarged portion 102 in the direction of arrow 106 and forces ball 100 away from channel 98 to permit air to pass into mouth 96 and engine 16. This eliminates air entrapment in the coolant system 10. Fluid pressure from the engine side in the direction of arrow 108 forces ball 100 against vent channel 98 to restrict fluid flow through vent channel 98 when the engine is started. Advantageously, vent channel 98 and valve ball 100 are built into fill housing 18. This eliminates the need for a separate metal stamping for a thermostat flange to provide such a vent.

Figure 8:
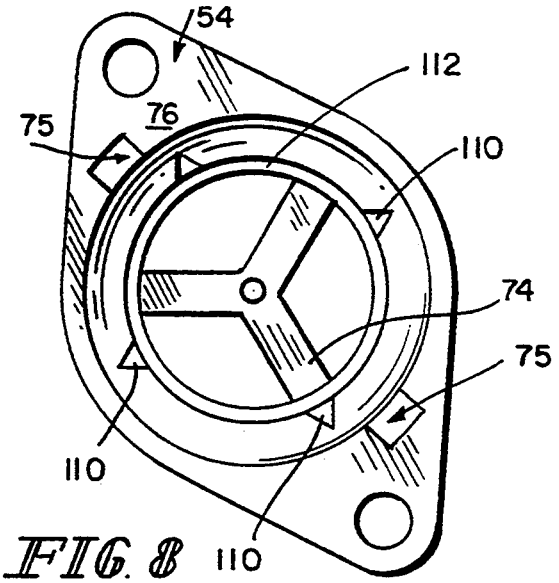
FIG. 8 is an end view of another embodiment of the coolant fill housing of the present invention, without the thermostat installed, illustrating the configuration of weir channels formed in the coolant fill housing.

Another embodiment of the present invention is illustrated in FIGS. 8–12. Those elements referenced by numbers identical to numbers in FIGS. 1–7 perform the same or similar function. FIG. 8 illustrates a modified inlet end of fill housing 18 formed to include a plurality of weir channels 110. Weir channels 110 cooperate with integral thermostat 68 to provide a controlled flow feature for the present invention. Weir channels 110 are formed in fill housing 18 between mouth 72 and inlet section 52. Weir channels 110 are located adjacent a valve seat 112 which is configured to engage movable valve member 88 of thermostat 62. The weir channels 110 are configured in three dimensions to allow moderate fluid flow to pass through weir channels 110 and into inlet section 52 of fill housing 18 as the valve 88 of thermostat 62 begins to open. This configuration reduces a sudden surge of coolant fluid exhibited when a typical thermostat is used.

Figure 9A:
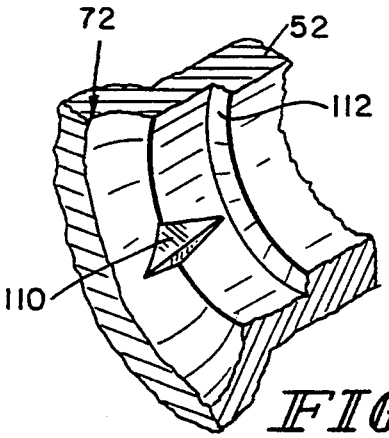
FIG. 9*a* is a partial perspective view of the coolant fill housing of FIG. 8 further illustrating the configuration of one configuration of the weir channels shown as a triangular cross section.
Figure 10:
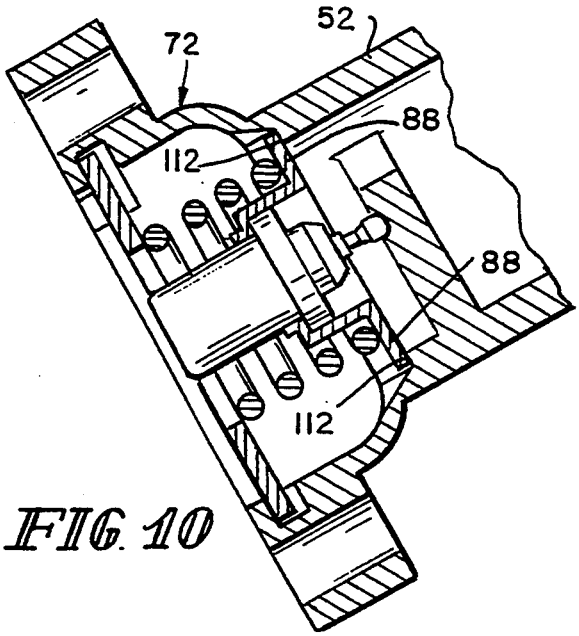
FIG. 10 is a sectional view taken through the coolant fill housing illustrated in FIG. 8 with a thermostat installed, the thermostat being in its fully closed position to block fluid flow through the coolant fill housing.
Figure 9B:
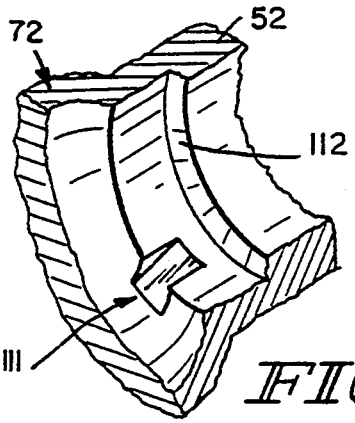
FIG. 9*b* is a partial perspective view similar to FIG. 9*a* illustrating a rectangular shaped weir channel.
Figure 11:
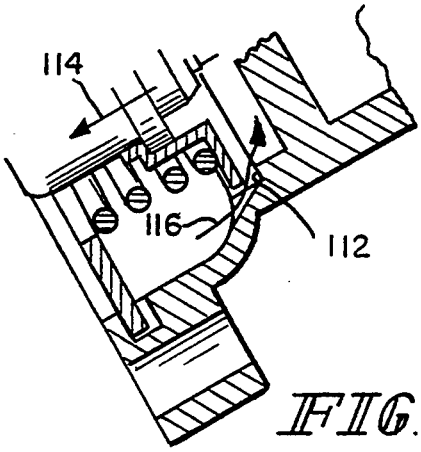
FIG. 11 is a partial sectional view similar to FIG. 10 illustrating movement of the movable valve member of the thermostat to a partially open position to permit fluid flow through the weir channels.
Figure 12:
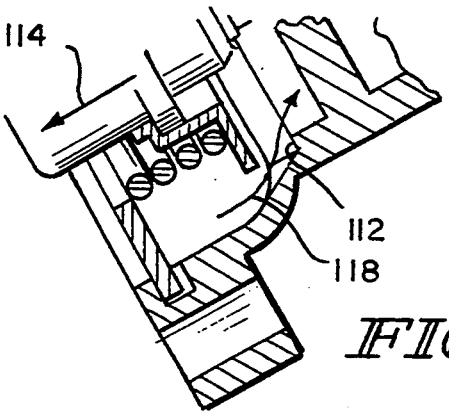
FIG. 12 is a partial sectional view similar to FIG. 11 illustrating the movable valve member of the thermostat in its fully open position to permit full fluid flow through the coolant fill housing.

The number of weir channels 110 can be changed depending upon flow parameters for a particular coolant system 10. In the illustrated embodiment, four such weir channels 110 are provided. As illustrated in FIG. 9*a*, weir channels 110 are typically, but not limited to, v-notched sections located slightly above valve seat 112. FIG. 9*b* illustrates another weir channel 111 having a rectangular shape. The weir channels may also have an oval or other three dimensional shape. Therefore, when movable valve 88 of thermostat 62 is in its closed position illustrated in FIG. 10, no fluid flow is provided through fill housing 18. However, as the coolant fluid temperature rises, power element 84 begins to move in the direction of arrow 114 in FIG. 11. Valve 88 coupled to power element 84 also moves in the direction of arrow 114 away from valve seat 112. When valve 88 moves slightly away from valve seat 112 as illustrated in FIG. 11, fluid flow is permitted through weir channels 110 in the direction of arrow 116 in FIG. 11. This fluid flow through weir channels 110 advantageously provides a moderate level of fluid flow during initial opening of valve 88. Weir channels 110 therefore provide controlled fluid flow as the thermostat valve 88 begins to open. As valve 88 continues to move in the direction of arrow 114 in FIG. 12, valve 88 moves to its fully opened position away from valve seat 112. This permits full fluid flow through fill housing 18 in the direction of arrow 118.

Although the invention has been described in detail with reference to a certain preferred embodiment, variations and modifications exist within the scope and spirit of the invention as described and defined in the following claims.

What is claimed is:

1. An apparatus for filling an engine cooling system with coolant fluid and for controlling fluid flow through the cooling system in response to changes of an engine cooling system temperature, the apparatus comprising:

a coolant fill housing including an inlet section, an outlet section, and a fill section configured to receive a cap thereon, the inlet section being formed to include a valve seat and a flange for coupling the fill housing to an engine; and a thermostat having a movable valve member for engaging the valve seat of the fill housing to block the flow of fluid past the valve member and into the inlet section, the thermostat including a retaining frame coupled to the flange for holding the thermostat within the inlet section beneath an outer surface of the flange, a spring extending between the retaining frame and the movable valve member for biasing the movable valve member to a normally closed position against the valve seat, a thermally responsive actuator coupled to the movable valve member for moving the movable valve member to an open position away from the valve seat when the ambient temperature exceeds a predetermined temperature to permit fluid flow from the engine into the inlet section of the fill housing.

2. The apparatus of claim 1, wherein the flange of the fill housing includes a pair of notched sections for receiving a pair of tabs formed on the retaining frame to couple the retaining frame to the flange.

3. The apparatus of claim 1, wherein the outlet section is aligned at an obtuse angle relative to the fill section to reduce fluid flow into the fill section as fluid flows from the inlet section to the outlet section of the fill housing.

4. The apparatus of claim 1, wherein the fill housing is formed to include a venturi portion located between the inlet section and the outlet section to provide a pressure drop in the fill housing as fluid flows through the fill housing.

5. The apparatus of claim 4, wherein the venturi portion is located adjacent the fill section to subject the fill section to the pressure drop as fluid flows through the fill housing.

6. The apparatus of claim 1, wherein the thermally responsive actuator of the thermostat includes a stem portion and a power element, and the fill housing includes an internal rib positioned in the inlet section downstream from the valve seat for supporting the stem portion.

7. The apparatus of claim 6, wherein the internal rib is formed integrally with the fill housing.

8. The apparatus of claim 7, wherein the internal rib and the fill housing are made from a plastic material.

9. The apparatus of claim 1, wherein the fill housing is formed to include a three dimensional weir channel adjacent the valve seat to permit fluid flow through the weir channel as the valve member moves away from the valve seat.

10. The apparatus of claim 1, wherein the fill housing is formed to include a vent channel and a valve located in the vent channel.

11. The apparatus of claim 10, wherein the vent channel includes an enlarged portion and the valve includes a restrictor located in the enlarged portion to open and close the vent channel.

12. The apparatus of claim 11, further comprising a flexible lip portion formed adjacent the enlarged portion of the vent channel to permit the valve restrictor to be inserted into the enlarged portion of the vent channel.

13. The apparatus of claim 1, wherein the fill section includes a removable cap and means for transporting fluid between a fluid reservoir and the coolant fill housing.

14. The apparatus of claim 1, wherein the retaining frame is coupled to the flange by a bayonet attachment to hold the thermostat in the inlet section of the fill housing beneath the outer surface of the flange.

15. A fill housing apparatus for filling an engine cooling system with coolant fluid, the apparatus comprising an inlet section with means for connection to an upper portion of the engine, an outlet section with means for connection to an upper portion of an engine cooling radiator, a fill section configured to receive a removable cap thereon to permit coolant fluid to be added to the cooling system, and a venturi portion located between the inlet section and the outlet section to provide a pressure drop inside the fill housing as fluid flows from the engine through the fill housing to the radiator.

16. The apparatus of claim 15, wherein the outlet section is aligned at an obtuse angle relative to the fill section to reduce fluid flow into the fill section as fluid flows from the inlet section to the outlet section of the fill housing.

17. The apparatus of claim 15, wherein the venturi portion is located adjacent the fill section to subject the fill section to the pressure drop as fluid flows through the fill housing.

18. The apparatus of claim 15, wherein the inlet section is formed to include a valve seat and a flange for coupling the fill housing to an engine, and further comprising a thermostat coupled to the flange, the thermostat being located beneath an outer surface of the flange.

19. The apparatus of claim 18, wherein the thermostat includes a movable valve member for engaging the valve seat of the fill housing to block the flow of fluid past the valve member and into the inlet section, a retaining frame coupled to the flange for holding the thermostat within the inlet section, a spring extending between the retaining frame and the movable valve member for biasing the movable valve member to a normally closed position against the valve seat, and a thermally responsive actuator coupled to the movable valve member for moving the movable valve member to an open position away from the valve seat when the ambient temperature exceeds a predetermined temperature to permit fluid flow from the engine into the inlet section of the fill housing.

20. The apparatus of claim 19, wherein the retaining frame is coupled to the flange by a bayonet attachment to hold the thermostat in the inlet section of the fill housing beneath the outer surface of the flange.

21. The apparatus of claim 19, wherein the thermally responsive actuator of the thermostat includes a stem portion and a power element, and the fill housing includes an internal rib formed integrally with the fill housing in the inlet section for supporting the stem portion.

22. The apparatus of claim 19, wherein the fill housing is formed to include a weir channel adjacent the valve seat to permit fluid flow through the weir channel as the valve member moves away from the valve seat.

23. The apparatus of claim 19, wherein the fill housing is formed to include a vent channel and a valve located in the vent channel.

24. An apparatus for filling an engine cooling system with coolant fluid and for controlling fluid flow through the cooling system in response to changes of an ambient temperature, the apparatus comprising a fill housing including an inlet section, an outlet section, and a fill section configured to receive a cap thereon, the inlet section being formed to include a valve seat and a flange for coupling the fill housing to an engine, a thermostat, and means for coupling the thermostat to the flange to hold the thermostat within the inlet section beneath an outer surface of the flange.

25. The apparatus of claim 24, wherein the fill housing is formed to include a venturi portion located between the inlet section and the outlet section to provide a pressure drop in the fill housing as fluid flows through the fill housing.

26. The apparatus of claim 24, wherein the fill housing is formed to include a vent channel and a valve located in the vent channel.

27. The apparatus of claim 24, wherein the thermostat includes a movable valve member for engaging the valve seat of the fill housing to block the flow of fluid past the valve member and into the inlet section, a retaining frame coupled to the flange for holding the thermostat within the inlet section beneath the outer surface of the flange, a spring extending between the retaining frame and the movable valve member for biasing the movable valve member to a normally closed position against the valve seat, and a thermally responsive actuator coupled to the movable valve member for moving the movable valve member to an open position away from the valve seat when the ambient temperature exceeds a predetermined temperature to permit fluid flow from the engine into the inlet section of the fill housing.

28. The apparatus of claim 27, wherein the retaining frame is coupled to the flange by a bayonet attachment to hold the thermostat in the inlet section of the fill housing beneath the outer surface of the flange.

29. The apparatus of claim 27, wherein the thermally responsive actuator of the thermostat includes a stem portion and a power element, and the fill housing includes an internal rib formed integrally with the fill housing in the inlet section for supporting the stem portion.

30. The apparatus of claim 27, wherein the fill housing is formed to include a plurality of weir channels located adjacent the valve seat to permit fluid flow through the weir channel as the valve member moves away from the valve seat.

* * * * *